US005228405A

United States Patent [19]

Merten

[11] Patent Number: 5,228,405

[45] Date of Patent: Jul. 20, 1993

[54] POWER STEERING SYSTEM

[75] Inventor: Timothy W. Merten, Oshkosh, Wis.

[73] Assignee: Mer-Tech Inc., Oshkosh, Wis.

[21] Appl. No.: 670,533

[22] Filed: Mar. 15, 1991

[51] Int. Cl.[5] ..... B63H 25/22

[52] U.S. Cl. ..... 114/150; 440/61

[58] Field of Search ..... 114/150; 440/61, 53, 440/49; 91/420; 180/152

[56] References Cited

U.S. PATENT DOCUMENTS

| | | | |
|---|---|---|---|
| 3,135,095 | 6/1964 | Peterson | 114/150 |
| 3,180,096 | 4/1965 | Peterson | 114/150 |
| 4,568,292 | 2/1986 | Hall | 440/61 |
| 4,595,370 | 6/1986 | Small | 440/61 |
| 4,744,777 | 5/1988 | Ferguson | 440/61 |
| 5,074,193 | 12/1991 | Hundertmark | 440/61 |

FOREIGN PATENT DOCUMENTS 1133061 3/1957 France .

*Primary Examiner*—Jesus D. Sotelo

*Attorney, Agent, or Firm*—R. Jonathan Peters

[57] ABSTRACT

An in-line power steering system for a marine vehicle having a propulsion unit, including a steering arm, to effect steering movement thereof about a steering axis, and an operator actuable steering helm. A first actuable steering member, such as a mechanical push-pull cable, is operably connected to the steering helm and actuated in response to steering actuation at the helm. A power steering assist unit, operably connected to the first steering member, comprising a hydraulic cylinder-piston assembly and hydraulic fluid source is interposed between the steering helm and the first actuable steering member and mounted remote from the propulsion unit, and further is hydraulically actuated in response to steering actuation at the steering helm. An actuator for regulating the flow of hydraulic fluid through the power steering assist unit is operably connected to the first actuable steering member. A second actuable steering member, such as a mechanical push-pull cable, is operably connected to the power steering assist unit and to the steering arm for overcoming torque on the propulsion unit relative to the steering axis for effecting common movement of the steering member in response to steering actuation at the steering helm to pivot the propulsion unit about the steering axis.

37 Claims, 10 Drawing Sheets

POWER STEERING SYSTEM

FIELD OF THE INVENTION

This invention relates to a power steering system. In its more specific aspect, this invention relates to an in-line power steering system, particularly for marine vehicles.

BACKGROUND AND PRIOR ART

In a conventional steering system such as for outboard motors used on boats, the propulsion unit having a stern drive, mounted on the transom of the boat, is pivoted about a vertical steering axis upon steering actuation by the operator at the helm. One typical steering system for a boat having a stern drive comprises a steering cable extending between the steering helm and the propulsion unit so that steering at the helm actuates the cable for causing steering movement of the propulsion unit about a steering axis. A conventional steering cable is the push-pull cable comprising a reciprocative inner core slidable in a protective, flexible outer sheath or housing. One end of the cable is actuably connected to the steering helm, and the other end is actuably connected to the steering mechanism of the propulsion unit. When the wheel is turned at the helm, the cable is actuated by a push-pull movement of the inner core, thereby causing a steering movement of the propulsion unit. Hydraulic activated steering means can be used in place of the cable steering, wherein hydraulic fluid, e.g. oil, is pumped from the steering helm through conduits to a cylinder-piston control means in response to rotation of the steering wheel in one direction or the other. Actuation of the control means actuates the steering mechanism of the propulsion unit, thereby turning the propulsion unit in a common direction.

Prior art teaching steering systems of this type include the following U.S. Pat. Nos. 4,592,732; 4,615,290; 4,632,049; 4,568,292; and 4,295,833. Additionally, British Patent Application 2,159,483A discloses a power steering system for an outboard having a hydraulic cylinder-piston assembly and a control valve which is operated by an actuator including a push-pull cable to selectively extend and retract the piston rod and effect steering of the propulsion unit. The power steering assist system as taught in each of the prior art patents and British application identified above, however, is mounted onto and supported by the propulsion unit. Mounting the power steering system on the propulsion unit is disadvantageous for a number of reasons. First, the propulsion unit mounting position must be changed because there is a steering apparatus to conflict with the boat transom design during verticle tilt movement. In order to mount the power steering system to the propulsion unit, special bracketry is required for each engine design, because the mounting pads vary markedly depending on the design. Exemplary of engine mounting is the disclosure in the above identified British Patent Application, where, as shown in FIG. 7, the power assist unit 120 is mounted on a propulsion unit 10, which is mounted to a boat transom 22. As the propulsion unit 10 tilts about the horizontal axis 42, the power assist unit 120 may come into contact with the boat transom, thereby limiting its applicability. A second disadvantage is that the power steering system, including the supply and return lines which are under high pressure, are subjected to sun rays, salt water corrosion, and physical abuse because of exposure. Thirdly, such designs as shown in the prior art do not allow for steering shock to be absorbed partially by the steering cable, in that any steering shock is prevented from passing beyond the power assist steering system causing a high stress on the propulsion unit steering components. Lastly, the systems of the prior art, and in particular such a system as taught by the aforesaid British Patent Application, are designed to continuously supply fluid to the system, and not just when steering movement occurs. This constant fluid supply system wastes propulsion engine horsepower.

U.S. Pat. No. 497,706 discloses an in-line steering assist system in that the system is mounted remote from the rudder disposed adjacent the propeller. A retractable carriage is moved by a fluid actuated piston, and a cable extending from the piston, around pulleys on the carriage and to the rudder disk, moves the disk in response to movement of the piston. Little or no torque created at the rudder is consumed by the steering assist means to thereby reduce the steering effort required at the helm.

SUMMARY OF THE INVENTION

In accordance with the present invention, there is provided an in-line power steering system for a marine vehicle, such as for an outboard, comprising a propulsion unit pivotal about a steering axis, a steering helm, power steering assist means interposed between the propulsion unit and the steering helm and mounted remote from the propulsion unit, and a first actuable steering means operably connected to the helm and the power steering assist means to effect actuating input to the power steering assist means upon actuation at the steering helm, and a second, separate actuable steering means operably connected to the power steering assist means and the propulsion unit for providing actuable output to the propulsion unit to effect steering movement thereof about the steering axis. The steering helm typically includes a steering wheel and is operator actuable, and the first actuable steering means is operably connected at one end to the steering helm and at the opposed end to the power steering assist means which is actuated in response to steering actuation at the steering helm. The second actuable steering means is operably connected at one end to the power steering assist means for overcoming torque on the propulsion unit relative to the steering axis in response to actuable movement of said second actuable steering means. At its opposed end, the second actuable steering means is operably connected to the steering member of the propulsion unit for effecting common movement of the steering member in response to actuable movement of the second actuable steering means upon steering actuation of the steering helm to pivot the propulsion unit about the steering axis.

It will be observed that the power steering assist means is interposed between the helm and the propulsion unit or engine and mounted remote from the propulsion unit, and as used herein and in the appended claims the term "interposed between" is not restricted to the actual physical arrangement, but rather to the operable arrangement in that, for example when viewed in plan, the helm optionally can be arranged between the other two members, but in fact the power steering assist means is the operably interposed member. Further, regardless of the apparent physical arrangement, the power steering assist means is mounted remote from the propulsion unit.

Suitable actuable steering means may be mechanical, electrical or hydraulic, or a combination of any two as, for example, the first actuable steering means may be hydraulic and the second actuable steering means may be mechanical. In the preferred embodiment of the invention, the actuable steering means is the mechanical push-pull cable arrangement comprising a flexible outer sheath or cover and an inner core axially slidable in the sheath. The sheath protects the core, and also helps in directing the cable and in preventing the cable from coiling. If a mechanical cable is utilized for both, one end of each cable is operably connected to the power steering assist means, and the opposite end to the helm or to the propulsion unit. Steering actuation at the helm actuates the cable, more specifically the inner core, to effect input and output at the power steering assist means and thereby effect common movement of the steering member. Also, a plurality of steering cables may be used to provide output such as for a large engine or where two or more engines are used for the boat. Where desired, a hydraulic system may be utilized as an actuable steering means, and for one or both such means. Typically, a hydraulic system comprises a cylinder and piston arrangement operably connected with the power steering assist means, whether to effect input or output, and means for pumping pressurized fluid to one end of the cylinder to actuate the piston in response to steering movement at the helm. The steering helm, which is operator actuable, typically comprises a steering wheel and gear housing as for a push-pull cable, or valve and pumping housing for a hydraulic arrangement. Steering movement at the helm effects common movement at the steering member to pivot the propulsion unit about a vertical steering axis.

The power steering assist means comprises a hydraulic cylinder-piston assembly, having a valve control means normally biased to a closed position, and a hydraulic fluid source means for providing pressurized hydraulic fluid to the cylinder-piston assembly. The fluid source means comprises an accumulator means for delivering hydraulic fluid to the cylinder-piston assembly, and a reservoir means for accepting hydraulic fluid directed from the cylinder-piston assembly and passing the fluid to the accumulator. Actuating means operably connected to the first actuable steering means and to the valve control means will, upon steering movement, actuate the valve control means to open fluid communication and provide for delivery of pressurized fluid to the cylinder-piston arrangement from the fluid source means, thereby simultaneously providing output to actuate the second actuable steering means to effect common movement of the steering member. The actuating means selectively actuates the valve control means for a right turn direction or for a left turn direction, and this actuable movement is preset so that it is substantially equal for both turn directions. In the preferred embodiment, the valve control means comprises two spaced apart valve housings with the valve or valves biased to a closed position, and the actuating means opens the valves for one valve housing only depending on the steering direction, thereby directing the flow of pressurized hydraulic fluid. Pressurized hydraulic fluid delivered to the cylinder-piston assembly reciprocates the piston, and associated means operably connected to the piston actuates the output cable to effect common movement of the steering member.

The cylinder-piston assembly and fluid source means are supported by a suitable housing having a base plate for mounting to the boat, and because the system is in-line, it can be mounted in a place which is protected from exposure to the elements and to physical abuse. Further, in accordance with a preferred embodiment, there is provided a linking member between the first actuable steering means and the actuating means, which is free to reciprocate upon actuation of the steering means. The ram end of the piston in the cylinder-piston assembly is operably connected to the second actuable steering means, which provides output to the steering member. Also, the actuating means, which reciprocates upon steering actuation, includes means to adjust the travel distance of the actuating means so as to control the valve opening and thereby allowing for a desired or necessary increased rate of steering.

DETAILED DESCRIPTION AND PREFERRED EMBODIMENTS

Figure 1:
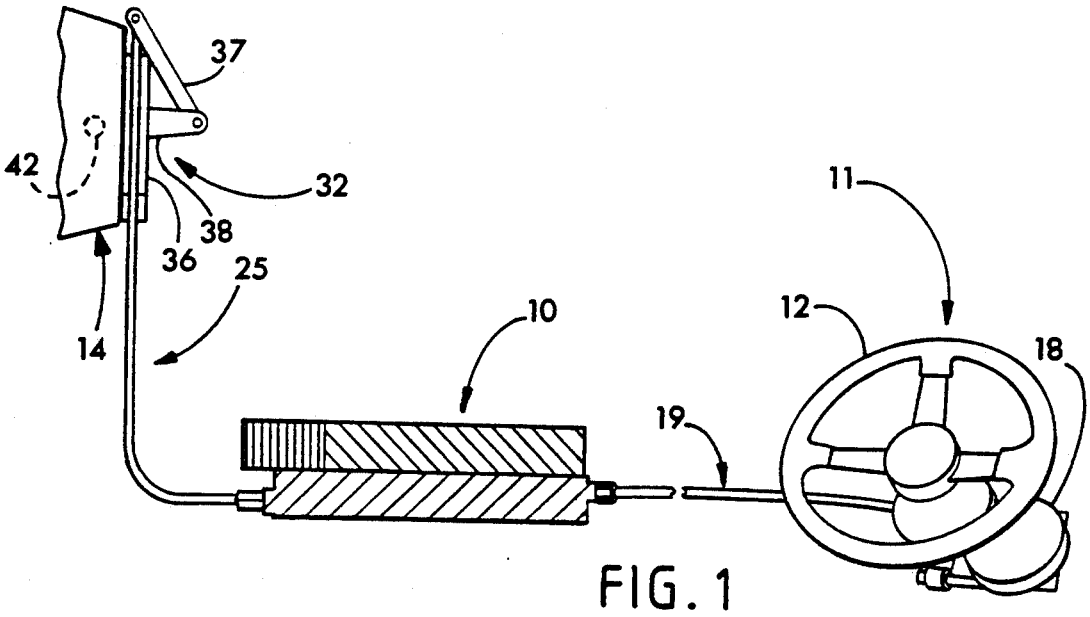
FIG. 1 is a schematic representation to show a steering arrangement utilizing the present invention for use in a marine vehicle.
Figure 2:
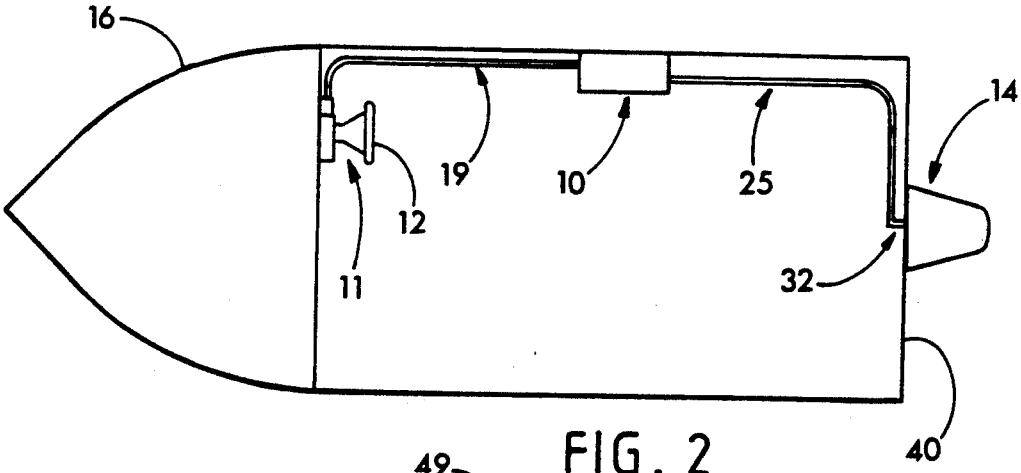
FIG. 2 is a diagramatic plan view of a boat utilizing the structure of the invention.
Figure 6:
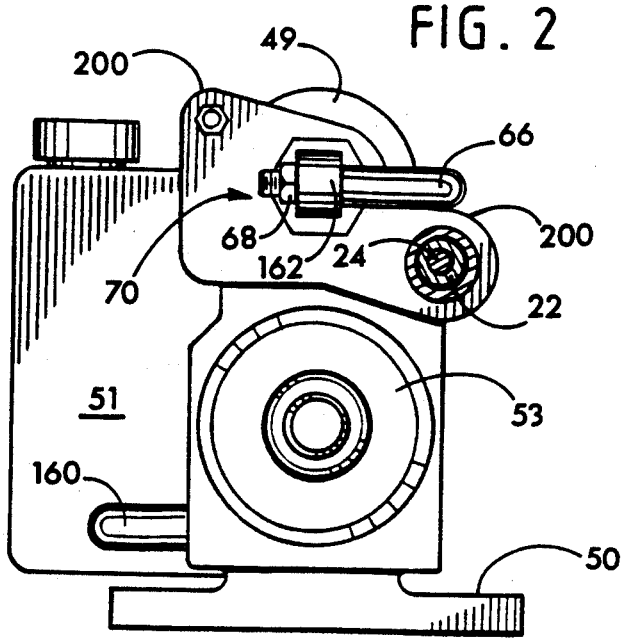
FIG. 6 is an end elevational view of the structure of FIG. 3.
Figure 3:
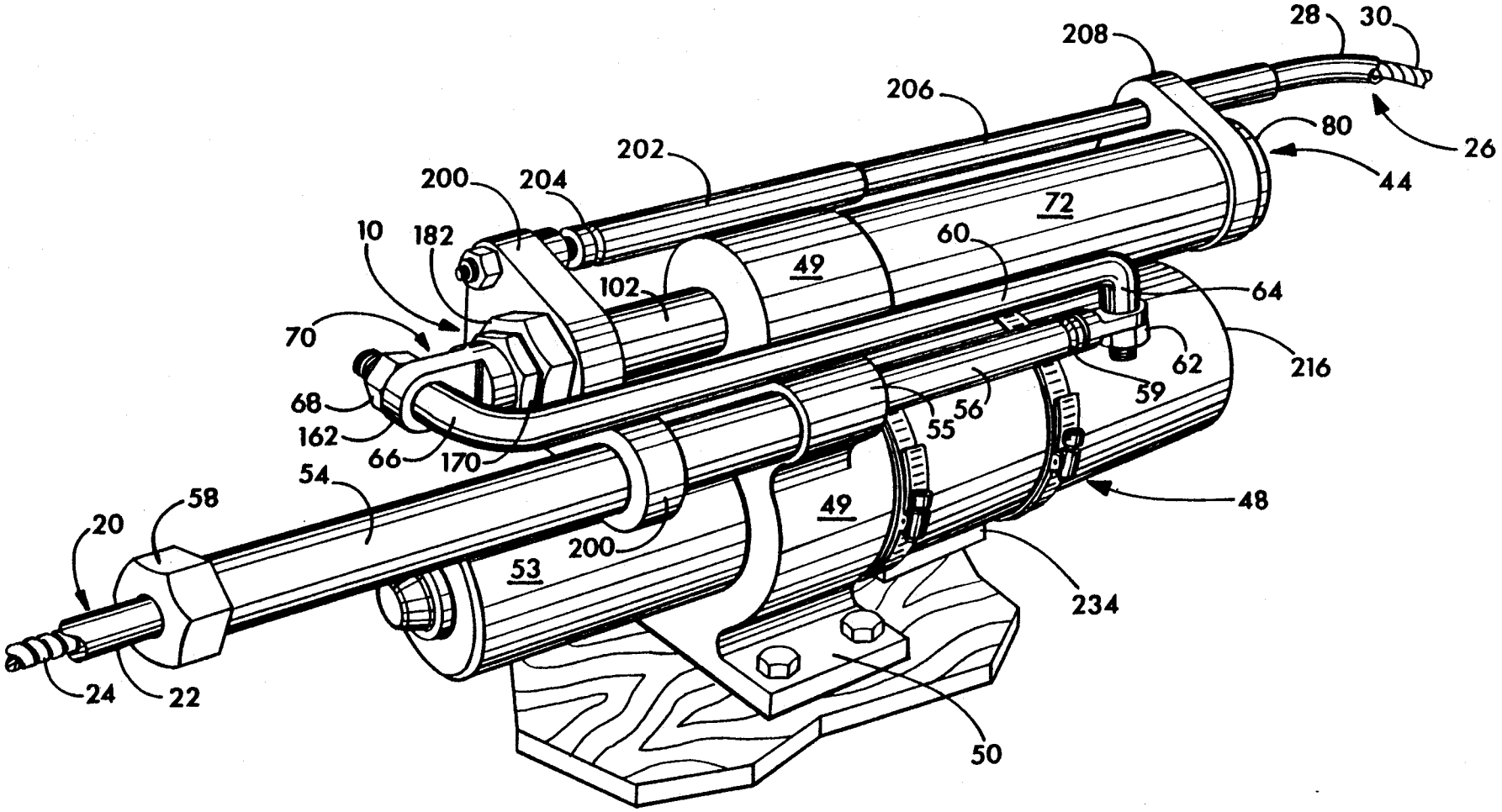
FIG. 3 is a perspective view of the power steering assist means of the present invention.
Figure 4:
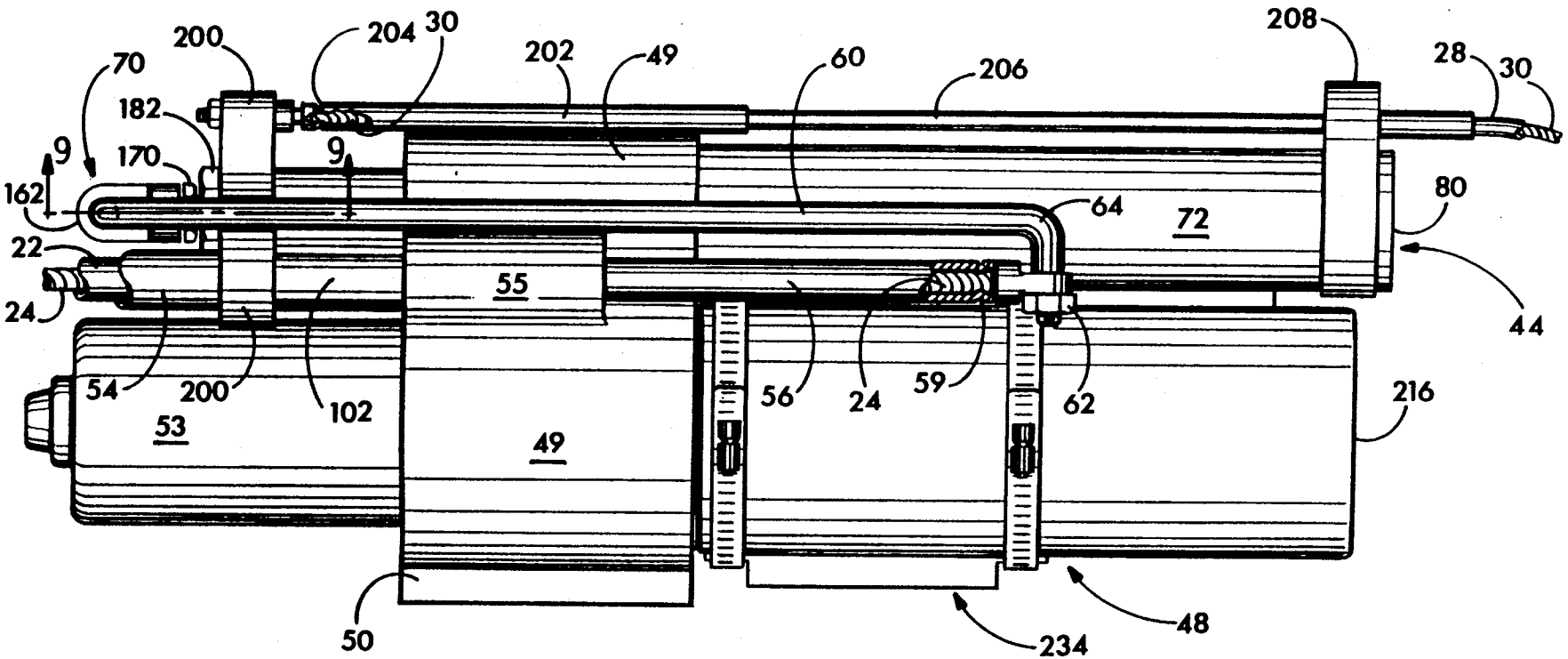
FIG. 4 is a side elevational view of the structure of power steering assist means shown in FIG. 3.
Figure 5:
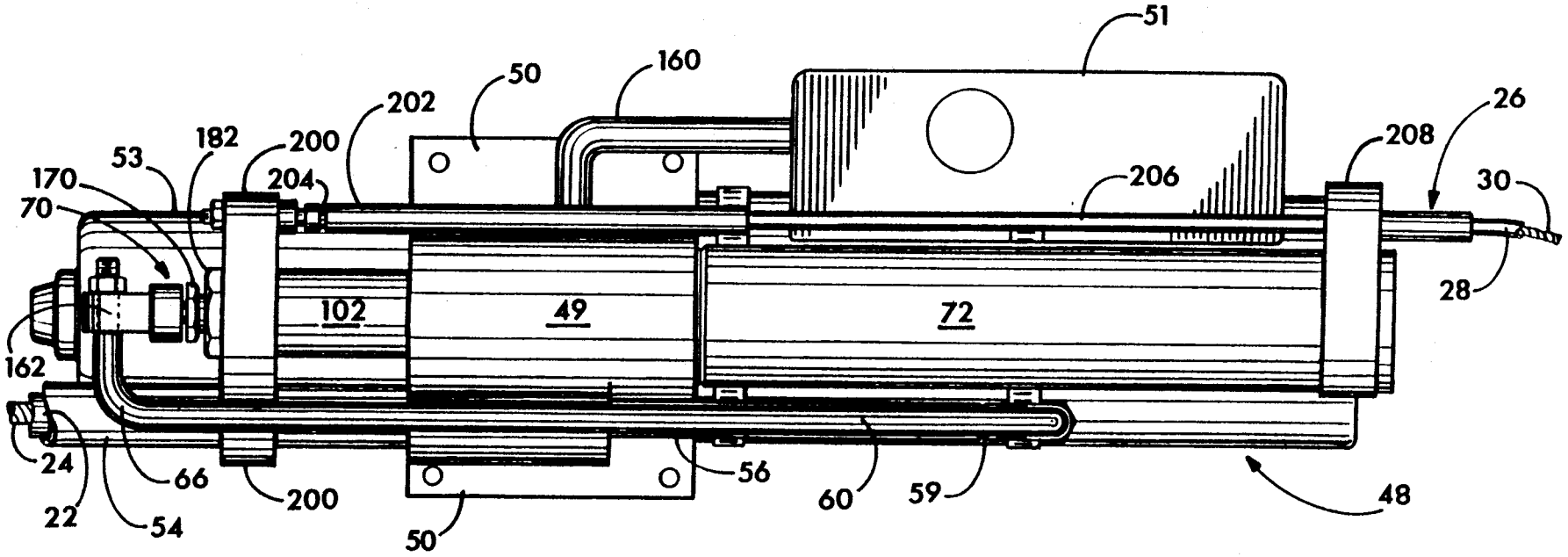
FIG. 5 is a plan view of the structure of FIG. 3.

Referring to the drawings, wherein the same reference numerals refer to similar parts throughout the various views, there is shown in FIGS. 1 and 2 an in-line power steering system of the present invention. In accordance with the present invention, the in-line power steering system includes a power steering assist means, indicated generally by the numeral 10, operably interposed between the steering helm 11, typically having a steering wheel 12, and the propulsion unit 14 and mounted remotely from the propulsion unit. It should be understood that the power steering assist means need not be physically positioned between the helm and the propulsion unit, but the power steering assist means is in-line in that it completes the actuable connection between the helm and propulsion unit. As shown, the steering helm 11 is positioned at or near the fore of the boat hull 16, and includes a steering gear housing 18. A first actuating steering means, indicated generally by the numeral 19, preferably comprises a first push-pull steering cable 20, having an outer sheath or cover 22 and inner core 24 which is slidably movable relative to the outer sheath, and is operably connected at one end to the steering gear housing 18 at the helm and is acuated in response to the operator actuated steering wheel 12, whereby rotation of wheel 12 in one direction or the other actuates the inner core 24, as described below in detail. (See FIGS. 3 and 4.) The opposite end of first cable 20 is operably connected to power steering assist means 10, comprising a hydraulic fluid pressure actuated means, described below in detail, and provides power steering assist in response to actuation of the first steering means. It will be observed that this first cable accepts input from the steering helm, and transfers the input to the power steering assist means. A second actuating steering means indicated generally by the numeral 25, preferably a second push-pull cable 26, having an outer sheath or cover 28 and inner core 30 which is slidably movable relative to the outer sheath, is operably connected at one end to the power steering assist means 10 at a position separate and removed from the connection of the first cable 20. That is, first cable 20 and second cable 26 are not connected, but actuation of cable 20 as a result of steering movement at the helm, actuates power steering assist means 10, which in turn actuates the second cable 26. This second steering cable accepts output from the power steering assist means, and transfers the output to the propulsion unit, or, more specifically to the steering member of the propulsion unit. Second steering cable 26 is actuably connected at its opposite end to steering member 32 of propulsion unit 14, which typically includes a tilt tube 36, steering link 37 and steering arm 38, and is mounted on transom 40 of boat hull 16 for pivotal movement about a vertical steering axis 42 (the steering axis envisioned as being substantially normal to the surface of the water). Actuation of the second cable 26 effects steering movement of the propulsion unit.

The power steering assist means 10, which is mounted between the steering helm and propulsion unit and remotely from the propulsion unit, includes a hydraulic cylinder-piston assembly 44, having a valve control means 46, and a fluid source means 48 spaced apart from and in fluid communication with said hydraulic assembly 44 for providing pressurized fluid to the hydraulic assembly. Housing 49, having a base 50, supports the hydraulic assembly and fluid source means (as described below in detail), and the steering assist means 10 is mounted to the boat at the base plate 50. (See FIG. 3.) Tank member 51, for holding hydraulic fluid, and pump 52, operated by motor 53, are disposed for fluid communication with said hydraulic cylinder-piston assembly 44 and fluid source means 48. The linkage comprising first steering cable 20, second steering cable 26 and interposed power steering assist means 10, operates in conjunction with and upon actuation of steering wheel 12 to effect steering movement of the propulsion unit. Thus, when the hydraulic cylinder-piston assembly 44 is actuated in response to steering movement at the helm, pressurized hydraulic fluid, (e.g., pressurized oil) flows through the hydraulic assembly 44 delivered from the fluid source means 48, as described below in detail. Torque from the propulsion unit 14 is overcome by the power steering assist means 10 thereby reducing the effort at the steering wheel to only the effort required to operate the hydraulic cylinder-piston assembly 44, which is independent of the torque generated by the propulsion unit.

The power steering assist means 10 operably connecting the steering helm to the propulsion unit is shown in greater detail in FIGS. 3 through 9. As shown in the illustrative embodiment, horizontally disposed sleeve 54 is fixedly supported at one end by boss 55 laterally extending from the housing 49, and sleeve 54 is mounted externally of and spaced from the hydraulic cylinder-piston assembly 44. Sleeve 54 has a longitudinal bore for slidably receiving concentrically disposed coupling tube 56 extending along the longitudinal axis thereof and projecting therefrom to leave an exposed end. Thus, coupling tube 56 is free for reciprocal slidable movement in the bore of sleeve 54. First steering cable 20, leading from the steering helm 11 where it is operably connected at one end, is passed through sleeve 54 and to the end of coupling tube 56 where it is affixed. More specifically, outer sheath 22, as the protective housing for the inner core, terminates at the entrance to sleeve 54 at the end opposite from which coupling tube 56 projects, and is connected thereto by threaded member 58. Inner core 24 of first steering cable 20 is passed longitudinally through sleeve 54 and to about the end of coupling tube 56 and connected at this opposite end to the tube by crimp 59. (See FIG. 4.) Thus, actuation of the first steering cable in response to a command from the steering helm effects common movement of the coupling tube 56.

A reciprocating linking member 60, such as a linking rod or linking arm, extends from the exposed end of coupling tube 56 and is operably connected thereto by threaded member or nut 62 at or near the end to which the inner core 24 of cable 20 is affixed. In a preferred embodiment, linking member 60 comprises a horizontally disposed, elongated rod arranged in spaced parallel relationship to sleeve 54, and thus to coupling tube 56, and is connected at the exposed end of coupling tube 56 by downwardly or transversely extending elbow 64 formed integrally with linking member 60 so as to reverse the direction of linking member 60 relative to the disposition of the cable and coupling tube and thereby save space. Elbow 64 is provided with a threaded end for threadedly engaging internally threaded member or nut 62 thereby operably connecting linking member 60 to coupling tube 56. It will be observed that because the coupling tube 56 and linking member 60 are conjoined, reciprocal movement of the coupling tube moves the linking member in the same direction. Linking member as rod 60 is provided at its opposite end with laterally extending elbow 66, formed integrally with linking member 60 and having its longitudinal axis in a plane substantially normal to the longitudinal axis of elbow 64. Elbow 66 is connected by threaded member 68 at this opposed end to actuator 70 operably connected to the hydraulic cylinder-piston assembly 44, thereby establishing operable connection between the steering helm and the hydraulic assembly.

The hydraulic cylinder-piston assembly 44 includes a cylinder 72 having a bore 74 for accommodating valve control means 46 comprising a reciprocating piston 76 mounted for reciprocating movement in bore 74. (See FIGS. 7 and 8.) The piston 76, having end cap 77 forming the piston head and opposed to the ram end, is affixed to the piston and provided with openings 78 and an integrally formed plug 79 extending laterally into the piston, is spaced from the cylinder end wall 80 thereby defining chamber 81 at one end of the cylinder for accommodating a hydraulic fluid, e.g. oil. The opposed end of cylinder 72 is externally threaded at 83. Housing 49 comprises an axially extending, generally cylindrical open-ended bore for supporting the hydraulic cylinder-piston assembly, said bore having an enlarged cylindrical section 85 of a first diameter terminating inwardly at annular shoulder 86, and a coaxial second cylindrical section 87 of a second diameter smaller than said first diameter of section 85. Section 85 is internally threaded at 88 outwardly from shoulder 86, and the externally threaded portion 83 of cylinder 72 is threadedly engaged to section 88 such that the terminus of cylinder 72 is spaced from annular shoulder 86 so as to form annular passageway 89. The cylinder 72, having its longitudinal axis substantially coaxial with the longitudinal axis of the enlarged cylindrical section 85 of the bore, is thereby supported at this end by the housing.

Piston 76 is mounted for reciprocative movement in the bore 74 of cylinder 72, and is provided with appropriate sealing gaskets and bearings (not shown) to prevent fluid leakage along the outside surface of the piston. The ram end of piston 76 has a smaller diameter than the head end as defined by a first annular reduced portion of smaller diameter than the head diameter, and this reduced portion has a lateral or inwardly extending annular shoulder 90 and wall 92, said wall having a plurality of spaced apertures 93 for reasons more fully explained below. A second annular reduced portion of still smaller diameter has an inwardly extending annular shoulder 94 and wall 96, which is externally threaded. Bore 98, having its longitudinal axis substantially coaxial with cylinder 72, extends from plug 79 to the threaded section of wall 96 and terminates with enlarged central opening 100. Tubular or annular ram rod 102, concentrically arranged with and coaxially disposed along the longitudinal axis of cylinder 72 and spaced inwardly therefrom, extends longitudinally from the ram end of piston 76 outwardly from the terminus of cylinder 72, and is slidably retained by the second cylindrical section 87 of the housing 49 and is fixedly connected at its terminus to actuator 70. In the illustrative embodiment, each of the opposed ends of annular ram rod 102 is provided with internally threaded recesses 104 and 106. Threaded recess 104 of ram rod 102 threadedly engages the threaded section of wall 96, and the terminus of the ram rod abuts shoulder 94 of piston 76. The opposite end 106 of ram rod 102 is threadedly engaged with actuator 70, as explained below in detail. It will be observed that the wall 92 of piston 76 is of slightly larger diameter than the outside diameter of ram rod 102, and this offset serves as a stop upon contact with shoulder 86 thereby limiting the extension of the ram rod, and these members being concentric with cylinder 72 cooperate therewith to define annular channel 108, which is in fluid communication with fluid passageway 89 at one end and apertures 93 at the other end. Annular ram rod 102, disposed substantially concentrically with cylinder 72, has an axial passageway or channel 110 relative to the longitudinal axis, and is in fluid communication with the valve control means 46, as described below.

As explained above, valve control means 46 includes reciprocating piston 76 mounted for reciprocal movement in bore 74 of cylinder 72. Tie rod 112 extends longitudinally through channel 110 and is operably connected at threaded end 114 to actuator 70 and at the opposite threaded end 116 to valve control means 46. Piston 76 is provided with a longitudinal bore 118 which is substantially coaxial with channel 110, and extends from the facing of plug 79 to define spacing or opening 120 and terminates outwardly therefrom at opening 100. Annular ball actuator 122, having an open-ended longitudinal bore 124, is mounted in bore 118 for reciprocative movement axially relative to piston 76. The opposite end of ball actuator 122, extending outwardly into opening 100, is internally threaded at 126. Ball actuator 122 is provided with at least one and preferably a plurality of apertures 128 disposed inwardly from threaded section 126 for establishing fluid communication between channel 110 and bore 124. Interposed between the apertures 128 and the terminus at opening 120 are spaced apart annular flanges 130 and 132, which extend transversely outwardly from the cylindrical wall of ball actuator 122 into chambers 133 and 134, respectively. End 116 of tie rod 112 is externally threaded to threadedly engage threaded section 126 of ball actuator 122. Because tie rod 112 is operably connected to ball actuator 122, when reciprocal movement of tie rod 112 is caused by movement of actuator 70, ball actuator 122 is moved axially relative to piston 76.

Figure 8:
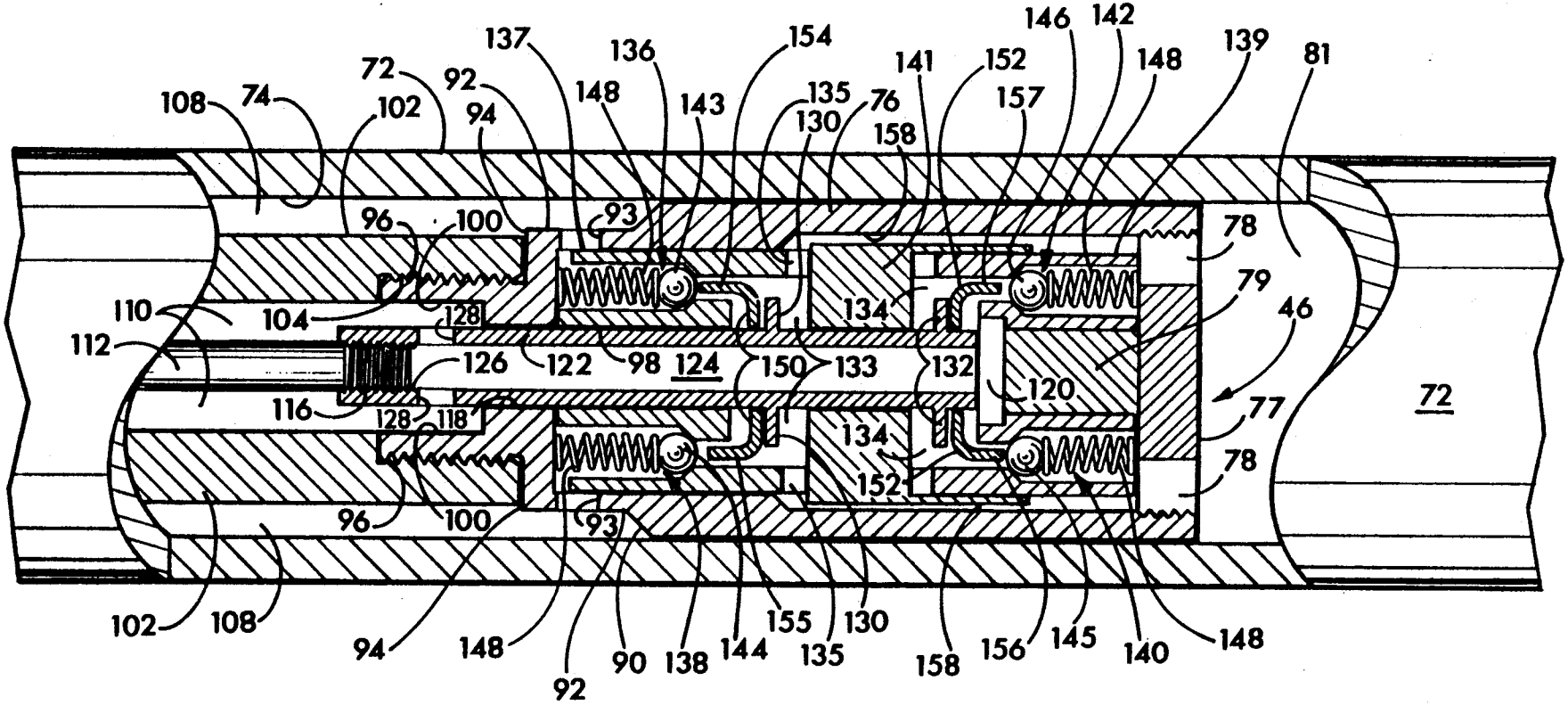
FIG. 8 is a cross-sectional view on line 8—8 of FIG. 7 showing in detail the valve control means.

As more clearly shown in FIG. 8, valve control means 46 further includes (a) ball check valves 136 and 138 disposed in valve body 137 for controlling the flow of pressurized hydraulic fluid delivered from the fluid source means 48 through a first fluid communication means to chamber 81 (described below), and, separated by divider 141, (b) ball check valves 140 and 142 disposed in valve body 139 for controlling the flow of pressurized hydraulic fluid from chamber 81 through a second fluid communication means (described below). In this manner, the flow of hydraulic fluid, e.g. oil, is essentially in one direction only. As shown in the illustrated construction, each ball check valve has a check ball shown as check balls 143, 144, 145 and 146, and when in a no steering change position, each ball check valve is maintained in a closed position by suitable bias means 148, such as a coiled spring, which biases each ball against a cooperating seat so as to prevent the passage of oil through the ball check valve. In this position, the valve control means 46 is locked and cannot be moved. Ball actuator pins 150 and 152, preferably formed as an annular member or ring insertable on the ball actuator, has one or more transverse flanges or bosses 154, 155, 156 and 157 extending from the outer peripheral edge of the ring with the terminus spaced from the check ball when in a no steering change position. For each check ball there is a flange or boss member, and upon steering movement to the left or right, a boss is brought into contact with a check ball so as to unseat the ball. Upon axial movement of the ball actuator to the left or to the right, flange 130 or 132 engages actuator pin and forces a boss into engagement with with a check ball to move the check ball from its seat, thereby allowing for the flow of pressurized hydraulic fluid, e.g. oil, through the valve assembly, as explained below. Thus, it will be observed from FIG. 8 that when ball actuator 122 is moved to the left as by a left steering motion, pin 150 is moved to the left so that the bosses 154 and 155 engage check balls 143 and 144, thereby opening ball check valves 136, 138. Conversely, when ball actuator 122 is moved to the right as by a right steering motion, pin 152 is moved to the right so that the bosses 156 and 157 engage check ball 145 and 146, thereby opening ball check valves 140, 142. In a preferred embodiment, the boss 154 for pin 150 is longer than boss 155. As a consequence, upon axial movement of ball actuator 122, check ball 143 will be raised from its seat prior to, and without unseating check ball 144, and check ball 144 will be unseated to provide for an increased flow of pressurized hydraulic fluid for a left turn position only to increase the rate of turn, if required, of the actuation of the power steering assist system. Similarly, boss 156 for pin 152 is longer than boss 157, and therefore check ball 145 is opened first, and check ball 146 is opened to increase the rate of turn for a right turn.

Piston 76 includes annular channel 158 extending between ball check valves 136 and 138 and orifice 78 for supplying pressurized hydraulic fluid, e.g. oil, to chamber 81. Thus, annular channel 108 of cylinder 72 is in fluid communication with the valve body via ball check valves 136 and 138 through apertures 93 in the side wall of piston 76. When one or both of these valves is opened upon actuation of ball actuator 122 (e.g., steering is to the left, and therefore the ball actuator is reciprocated to the left as viewed in FIG. 8), fluid communication continues from chamber 133 via orifice or opening 135 to annular channel 158 extending longitudinally through piston 76, and then to orifice 78 in the end cap 77 of piston 76 and opening to chamber 81. It will be observed that pressurized fluid entering chamber 81 forces piston 76 to the left. In this manner, hydraulic fluid such as oil delivered from fluid source means 48 flows through the piston and into chamber 81, thereby completing a first fluid communication means between the fluid source means and chamber 81. The pressurized fluid flowing from chamber 81 and returning to fluid source means 48 flows through the piston 76 in an essentially different flow path. End cap orifice 78 opens in part to ball check valves 140 and 142, which in turn open to chamber 134 and then to opening 120 fluid communicating with bore 124 which is in fluid communication with axial channel 110 through apertures 128. Thus, when one or both ball check valves 140, 142 is opened upon actuation of ball actuator 122 in the opposite direction from that described above (e.g., to the right), communication means for permitting the flow of hydraulic fluid is established between chamber 81, through ball check valves 140 and 142, opening to bore 124 of the ball actuator, which in turn opens to axial channel 110. The opposite end of axial channel 110 is in fluid communication with return line 160 via passageways in actuator 70 and terminating at oil tank 51, and from the tank to fluid source means 48, as explained below in detail. The depletion of hydraulic fluid in chamber 81 causes the piston 76 to move to the right, thereby completing a second fluid communication means between chamber 81 and fluid source means 48.

Figure 9:
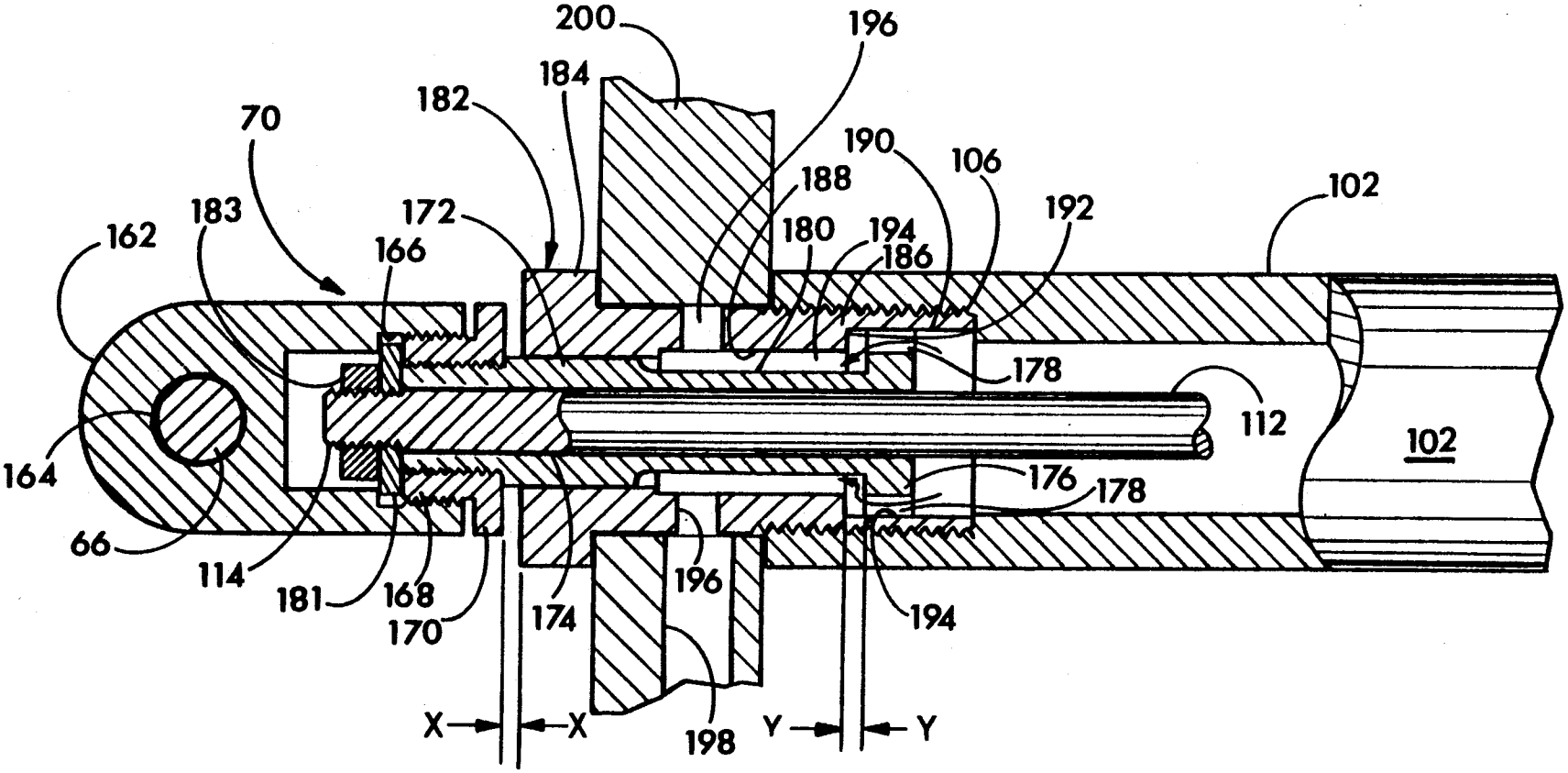
FIG. 9 is cross-sectional view on line 9—9 of FIG. 4 showing details of the actuator means.

As explained above, ram rod 102, disposed concentrically with and inwardly spaced from cylinder 72, extends from piston 76 where it is fixedly attached at the ram end, and is slidably retained through coaxial bore 84 of housing 49. At its opposite end, the ram rod is fixedly attached to actuator 70 as by threaded engagement at 106. Further, actuator 70, which controls or regulates flow of hydraulic fluid, is operably connected to linking member 60 and to tie rod 112 which, in turn, is operably connected at its opposed end to ball actuator 122, such that upon steering actuation at the helm to actuate cable 20, these elements (i.e., linking member, actuator, tie rod and ball actuator) reciprocate or move in unison thereby opening one or the other of the ball check valves 136, 138 or 140, 142 to permit the flow of hydraulic fluid through the assembly 44. In a preferred embodiment as shown in FIG. 9, actuator 70 comprises an outwardly disposed actuator head or clevis 162 having a first opening 164 for receiving elbow 66 of linking member 60, and a second opening 166, which is internally threaded near the terminus, said second opening having its longitudinal axis substantially normal to the longitudinal axis of the first opening and substantially coaxial with the longitudinal axis of tie rod 112. Collar 168, having a flanged annulus 170, is internally and externally threaded, wherein the externally threaded section is threadedly engaged with the internally threaded opening 166 of actuator body 162. Elongated sleeve member 172, having an open-ended longitudinal bore 174 for receiving tie rod 112, is externally threaded at one end to threadedly engage with the internally threaded section of collar 168. The sleeve terminates at its opposite end distal from its threaded end with flanged annulus 176 having one or more radial slots or apertures 178. Further, sleeve member 172 has a reduced section 180 of smaller diameter spaced from its threaded end and extending to the flanged annulus 176. Adjustment nut 181 is screw threaded onto the threaded section 114 of tie rod 112, and this length of engagement, which in actual practice can vary for each power steering apparatus because of machine tolerances, provides for a travel distance of "x—x" for the actuator 70. This brings adjustment nut 181 into abutment with collar 168, and locking nut 183 is threaded onto threaded section 114 to lock adjustment nut 181 to tie rod 112, and head 162 is threadedly engaged with collar 168 in order to secure or lock the position of adjustment nut 181 and therefore the travel distance. Anchor bracket bolt 182, comprising a head section 184 and shank 186, has an open-ended longitudinal bore 188 extending through said head and shank for slidably receiving sleeve 172. Further, shank 186 has an externally threaded terminus for threadedly engaging the internally threaded recessed terminus 106 of ram rod 102. This terminus of shank 186 includes annular opening 190 of larger diameter than bore 188 to receive flanged annulus 176 and terminates at lateral shoulder 192, and bore 188 cooperates with reduced section 180 of sleeve 172 to define channel 194. Shank 186 is provided with one or more radial openings or orifices 196 which open to fluid channel 198 in bracket 200 which is in fluid communication with return line 160 (see FIG. 7). Thus, for a no steering change position, annulus 170 of collar 168 is set by means of adjustment nut 181 to a predetermined position and locked in place so as to be spaced a travel distance of "x—x" from head 184 of anchor bracket bolt 182. As a consequence of this adjustment, flange 176 will be spaced from shoulder 192 a travel distance of "y—y" which is substantially equal to travel distance "x—x", as shown in FIG. 9. Thus, when steering is to the right, actuator 70 begins moving to the right to open one or both ball check valves 140, 142 and permit the flow of hydraulic fluid, e.g. oil, through valve control means 46 via the second fluid communication means described above, and, if the turn speed is increased, will move the complete travel distance "x—x" until flanged annulus 170 abuts head 184 thereby stopping any further movement of the actuator 70. Conversely, when steering is to the left, actuator 70 begins moving to the left to open one or both ball check valves 136, 138 to permit the flow of hydraulic fluid into valve control means 44 via the first fluid communication means described above, and, if the turn speed is increased, will move the complete travel distance "y—y"

until flanged annulus 176 abuts shoulder 192 thereby stopping any further movement of the actuator.

Bracket member 200 is operably connected to annular ram rod 102, and reciprocates in unison or in common with the reciprocative movement of the ram rod 102. (See FIGS. 3, 4, 5 and 7.) A first sleeve 202, having an axial bore, is affixed to bracket member 200 so as to reciprocate in common with the bracket member, and sleeve 202 extends transversely from the bracket member and is disposed substantially parallel to and spaced from both the ram rod 102 and hydraulic cylinder-piston assembly 44. The bore for sleeve 202 is adapted to receive one end of the inner core 30 of steering cable 26 for axial movement, and said end of core 30 is operably connected to the sleeve 202 as by a crimp 204 so as to reciprocate in common with the reciprocative movement of the sleeve. The opposite end of the inner core 30 is operably connected to steering member 32 of the propulsion unit 14. The inner core 30 projecting beyond the cover 28 and into sleeve 202 preferably is protected by a second sleeve 206 arranged concentrically with sleeve 202. Thus, when a second protective sleeve is used, the outer sheath 28 terminates at about the outward end of the second sleeve, and inner core 30 is inserted into this second sleeve and into sleeve 202 where it is affixed at its end. A support means 208, such as a bracket, mounted on hydraulic cylinder-piston assembly 44, supports the sleeve 206 and cable 26 and helps to properly direct the cable toward the propulsion unit. It will be observed that actuation of ram rod 102 actually reciprocates bracket 200 and in turn sleeve 202. Thus, reciprocative movement of bracket 200 actuates the inner core 30 of cable 26, thereby effecting common movement of steering member 32 in response to the steering actuation at the helm 12 to pivot the propulsion unit 14 about the steering axis 42.

Figure 7:
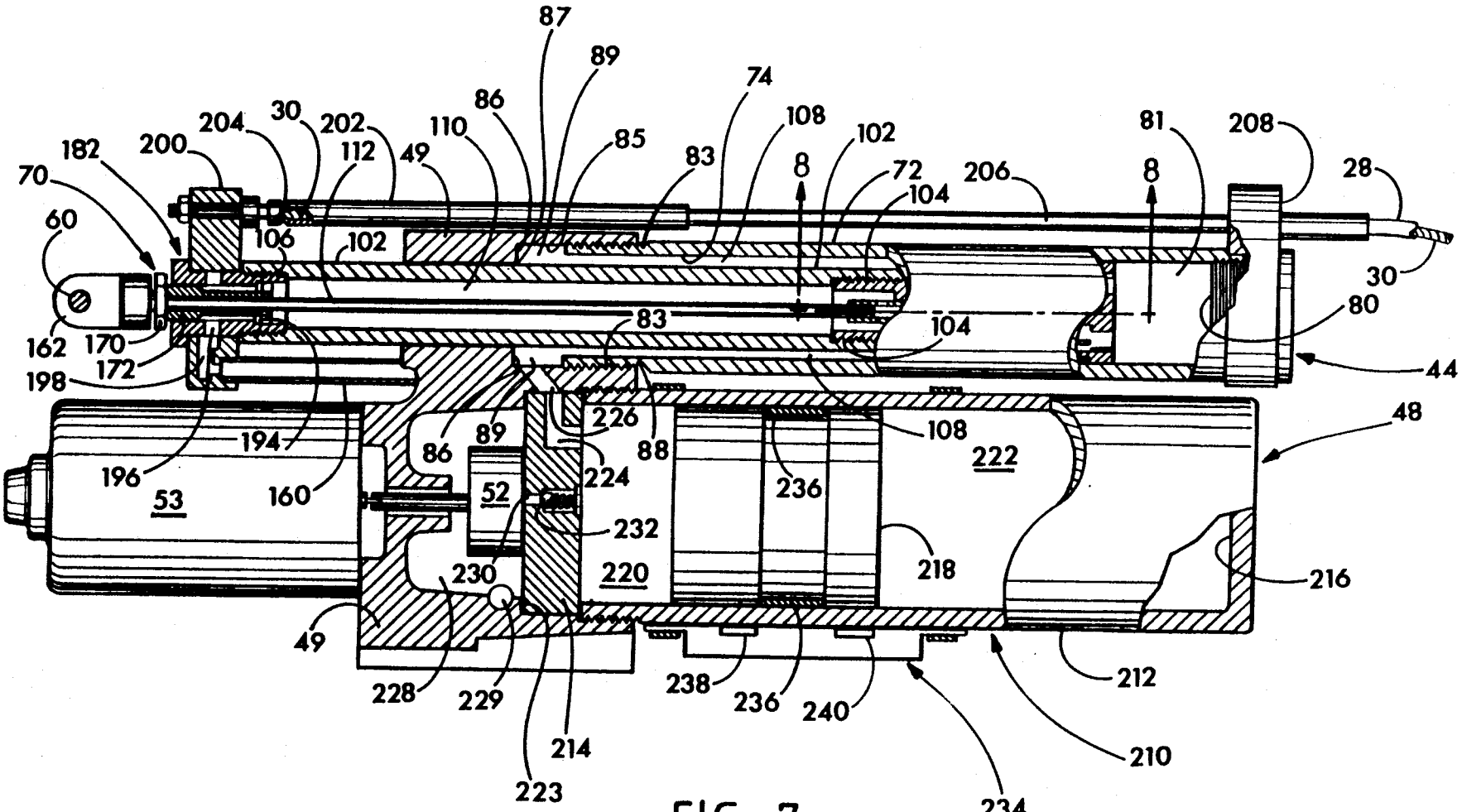
FIG. 7 is a cross-sectional side view of the structure of FIG. 4.

Referring now in particular to FIG. 7, there is shown fluid source means 48 having a cylinder-piston accumulator 210 comprising cylinder 212 closed at one end with wall 216 and having at the opposed end an externally threaded section 217, and piston 218 mounted for reciprocal movement in cylinder 212 which divides the cylinder into chambers 220 and 222. Housing 49 is provided with cavity 228 having an internally threaded terminus and annular shoulder 223, and cap or plug 214 is affixed in housing 49 and abuts shoulder 223. Fluid passageway 224 in cap 214 opening to aperture 226 in housing 49 provides fluid communication with annular passageway 89, thereby completing first fluid communication means extending from chamber 220 in fluid source means 48 to chamber 81 in hydraulic cylinder-piston assembly 44. Pump 52 is disposed in cavity 228, and the pump is operated by electric motor 53 having a suitable power source such as a battery or by a generator (not shown). Cavity 228 receives hydraulic fluid via second return line 229, and cooperably with tank member 51 and pump 52 provide a reservoir means for the hydraulic fluid. Conduit 230, having check valve 232, leads from the pump to the cylinder chamber 220 in the cylinder-piston accumulator 210. Hydraulic fluid, e. g. oil, is delivered to the assembly 48 via return line 229 which connects to the reservoir or cavity 228. The check valve 232, which prevents hydraulic fluid from returning to the pump, that is fluid flows in one direction only from the pump to the cylinder chamber 220, is normally closed. Piston 218 moves reciprocally within cylinder 212 in response to hydraulic fluid entering chamber 220 through conduit 230 or leaving chamber 220 through channel 224. Piston 218 is biased to a fluid delivery position by pressurized gas contained in the second chamber 222, such gas being typically nitrogen under a pressure of from about 800 to 1200 pounds per square inch. Thus, in the illustrated embodiment, hydraulic fluid is forced from chamber 220 by the pressure exerted on the piston by the gas in chamber 222 as by a left or right turn thereby actuating the actuator 70 to open one or both ball control valves. When ball control valves 136, 138 are opened, the pressurized hydraulic fluid passes from chamber 220 to chamber 81 via the first fluid communication means comprising channel 224, aperture 226, passageway 89, annular channel 108, apertures 93, ball check valves 136, 138, opening 135, chamber 133, annular channel 158, and aperture 78. Conversely, when ball check valves 140, 142 are opened, pressurized hydraulic fluid passes from chamber 81 and is returned to tank 51 and then to reservoir 228. When hydraulic fluid is pumped into chamber 220, piston 218 moves against the pressurized gas in chamber 222. This second fluid communication means comprises aperture 78, ball check valves 140, 142, opening 120, bore 124, aperture 128, axial channel 110, through the actuator 70 having aperture 178, channel 194, and orifice 196, and then to fluid channel 198, return line 160, tank 51, and second return line 229 into cavity or chamber 228.

Switch means, indicated generally by the numeral 234, which has been preset, operates the motor 53 for pumping the hydraulic fluid, e.g. oil, from reservoir 228 through check valve 232 into chamber 220. When fluid is pumped into chamber 220, piston 218 is moved against the pressurized gas in chamber 222. Suitable switch means 234 includes a magnetic ring 236 carried by piston 218 and sensors 238 and 240. As the piston reciprocates to predetermined positions, magnetic ring 236 trips the sensors 238 and 240 to start or stop the motor 53 for pumping hydraulic fluid such as oil. In the illustrated embodiment as shown in FIG. 7, the piston 218 is essentially in the midpoint of its travel. As hydraulic fluid in chamber 220 is depleted and the piston 218 moves to the left, magnetic ring 236 trips sensor 238 to start the motor. Fluid then is pumped into chamber 220 thereby moving piston 218 against the gas pressure until magnetic ring trips sensor 240 and turns off the motor 53.

In operation, which is described as using oil as the pressurized hydraulic fluid, the power assist steering means will operate in response to the steering movement at the helm by the operator. Assuming first that steering is to be to the left, that is the steering wheel is central and the propulsion unit is in a no-turn change position and the wheel is turned for a left turn movement, the helm actuates the inner core 24 of first cable 20 so as to move axially. The coupling tube 56, operably connected to the first cable at the end opposite to the connection at the helm, is reciprocated to move left, and hence linking arm 60, which is fixedly attached to the coupling tube, reciprocates to the left. The power steering assist means 10, which is operably connected to the first cable through the linkage means, is actuated upon movement of actuator 70 to the left.

Flange 130, depending from the ball actuator 122, is positioned such that upon reciprocal movement contacts or abuts actuator pin 150 and thereby forces open valves 136, 138 by unseating check balls 143 and 144 normally biased to a closed position by springs 148. Movement to the left of actuator 70 relative to the anchor bracket 200 moves tie rod 112 to the left thereby forcing the boss of ball actuator pin 150 to the left and against the ball valves. In the preferred embodiment, boss 154 is longer than boss 155, and initially check ball 143 only is unseated from its cooperating valve seat. The opening of valve 136 allows pressurized oil to flow from chamber 220 through the first fluid communication means comprising channel 224, opening 226, into passageway 89, through annular channel 108, through apertures 93 and ball check valve 136, through opening 135, into chamber 133, then to a second annular channel 158, and through apertures 78 and into chamber 81. Thus, the pressurized oil entering chamber 81 exerts a pressure on the piston 76 thereby moving it to the left along with ram rod 102 and anchor bracket 200. If the actuator 70 is kept in the same position relative to anchor bracket 200, the steering rate will remain constant. If the steering rate has to be increased, the actuator 70 will move a still greater distance to the left relative to the anchor bracket 200. This reciprocative movement of the actuator will move check ball 143 further from its seat to permit an increase in the flow of oil from chamber 220 thereby increasing the steering rate. If the rate is still insufficient, the actuator 70 is moved further to the left relative to the anchor bracket, which further actuates the tie rod 112 and moves ball actuator further to the left. This movement brings boss 155, the shorter boss, into contact with check ball 144 to unseat the check ball and open the valve 138. With both valves open, the flow of pressurized oil from chamber 220 through the first fluid communication means into chamber 81 is increased. If the relative position of actuator 70 to anchor bracket 200 is returned to its original position, check balls 143 and 144 are returned to their respective seats by reason of spring means 148 thereby blocking the flow of oil and stopping the steering movement.

When oil is delivered to chamber 81 from chamber 220 of the fluid source means 48, piston 76 is moved to the left. Thus, when the valves 136, 138 have been opened by a steering actuation, the force exerted on piston 218 by the pressurized gas in chamber 222 moves piston 218 to the left and thereby drives oil from chamber 220 to chamber 81 via the first fluid communication means. When the piston 218 reaches a predetermined position the magnetic ring 236 trips sensor 238, which turns on the motor 53 and starts the pump 52 to pump oil into chamber 220 via check valve 232. As the oil is pumped, additional oil enters reservoir 228 through the inlet line 229 from the oil tank 51. Oil entering chamber 220 moves the piston 218 to the right against the gas pressure in chamber 222. The check valve prevents oil from returning to the pump. When the piston 218 reaches a predetermined position, the magnetic ring trips sensor 240, which turns off the motor.

Assuming next a right turn movement, actuation of the linkage means is to the right. As actuator 70 moves to the right relative to anchor bracket 200, the tie rod 112 moves, which in turn moves ball actuator 122 and thereby brings the boss pins 156, 157 into contact with the check balls 145, 146. Again, in the preferred embodiment, boss 156 is longer than boss 157, and therefore check ball 145 is unseated first without unseating check ball 146. With the check ball valve 140 open, pressurized oil flows from chamber 81 to the oil tank 51 via the second fluid communication means comprising aperture 78, check ball valve 140, chamber 134, opening 120, bore 124, apertures 128, axial channel 110, through the channel openings 178, 194, 196 in actuator 70, and then through channel 198 to the oil tank 51 via return line 160. When oil flows out of chamber 81, piston 76 moves to the right thereby actuating the power steering assist means to the right to effect output via cable 26 for a right turn move. As in the case of the left turn movement described above, if the steering rate has to be increased, the actuator 70 continues to move a still greater distance to the right relative to the anchor bracket 200. This movement to the right eventually will bring boss 157 into contact with check ball 146 to open this valve and allow for the flow of additional oil from chamber 81, through the second fluid communication means and to the oil tank. This increased flow allows for a larger volume of oil to be exhausted from chamber 81, thereby allowing for an increased steering rate. Again, if the actuator 70 is allowed to return to its original position, springs 148 bias check balls 145, 146 to a closed position, and on reseating, block the flow of oil from chamber 81, thereby stopping the steering movement. As in the case of a left turn movement, when the system is moved to the right and oil is depleted from chamber 220, the motor operated pump goes through the same on and off cycle as the piston 218 carrying magnetic ring 236 trips sensors 238, 240.

Opening one check ball valve and then the other for each flow direction allows more flow control than opening two valves concurrently, or in using one larger valve opening. In this manner, the power steering assist means operates more smoothly, and reduces the chance of chatter. In addition, opening first one valve only reduces the initial force required to effect steering movement at the helm, because of the reduced seat area of one check ball when compared to two check balls or to one larger check ball. The area of the second valve seat is needed only if a very rapid steering rate is desired or necessary. Generally, the area of one valve seat is sufficient to operate the power steering assist means.

In the illustrated embodiment, the power steering assist means shows two check ball valves for each turn direction. It should be understood, however, that three or more ball check valves can be used. In the preferred embodiment, three ball check valves are used for each turn direction, because if the pump or motor should fail, the oil in chamber 81 and channels 108 and 89 would have to be pushed manually through the ball check valves. The multiple ball check valves provide for additional seat area, and with more area available, less force is required at the helm to manually move the power steering assist means.

Figure 10:
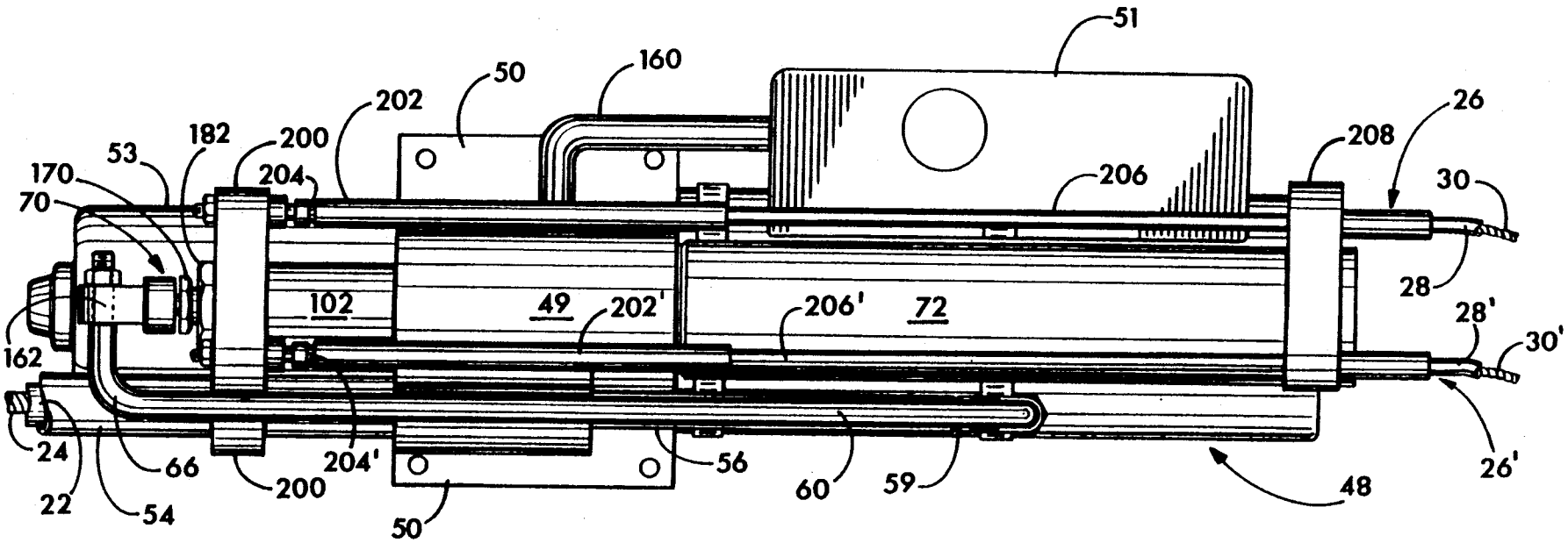
FIG. 10 is a perspective view showing an alternative embodiment of the present invention.

There is shown in FIG. 10 an alternative embodiment utilizing a plurality of steering actuating cables at the output end of the power steering assist means. As shown in the illustrative embodiment, there are two mechanical push-pull cables 26 and 26', which can be particularly useful for either an engine of high horsepower, e.g. 100 horsepower or higher, or for two or more engines. The construction for the two cables is essentially identical, and both cables are actuated simultaneously. The dual cable arrangement comprises cables 26 and 26' operably connected to anchor bracket 200, and both cables move simultaneously upon the reciprocal movement of bracket 200. As is the arrangement for cable 26, sleeve 202' reciprocally slides over sleeve 206', and the inner core 30' of cable 26' is inserted through both sleeves and affixed to sleeve 202' as by crimp 204'. Both cables 26 and 26' are supported at the one end by support means 208. Steering actuation at the helm in either direction reciprocally moves bracket 200, as explained above in detail, and both cables are actuated to effect steering movement at the propulsion unit or units.

Figure 11:
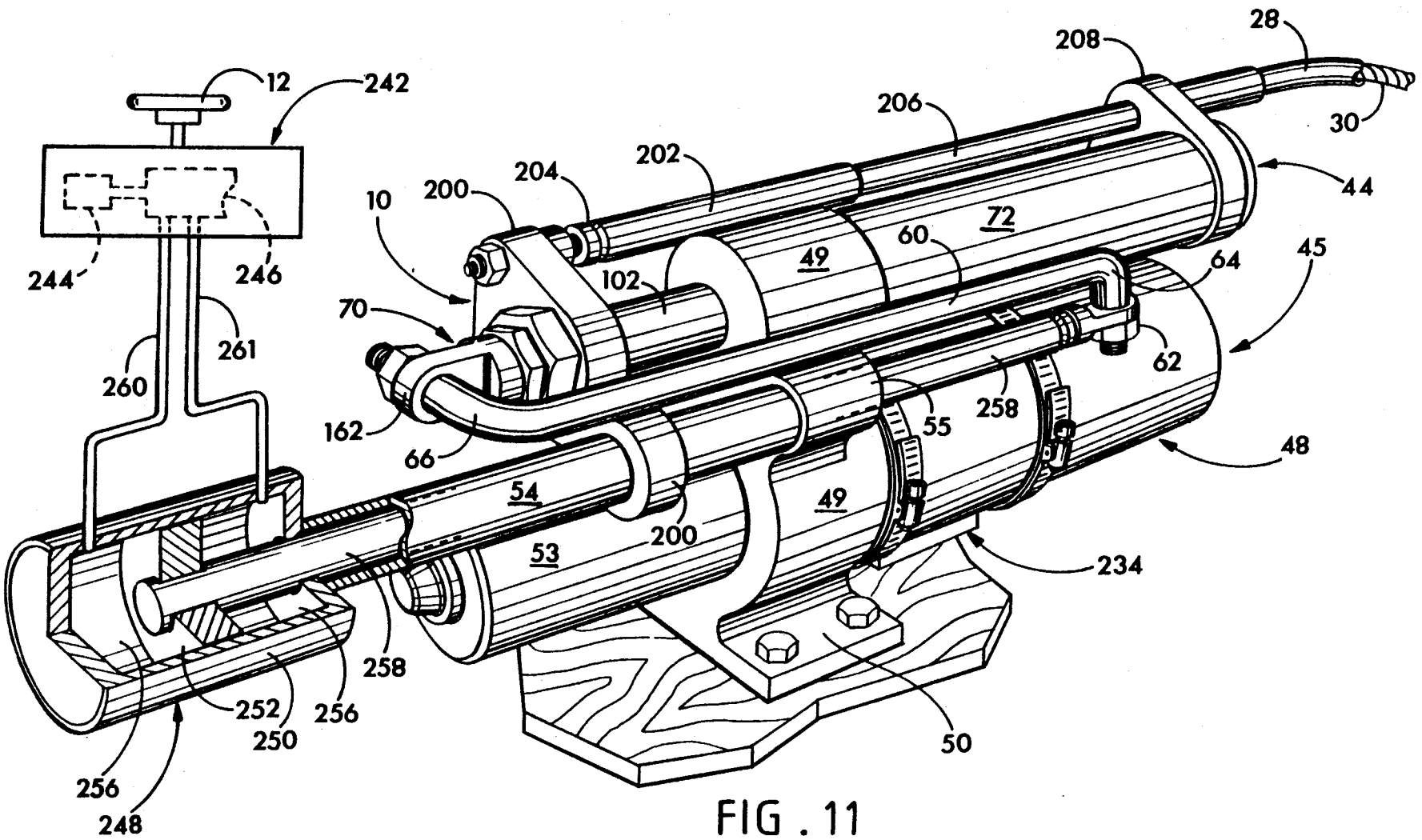
FIG. 11 is a schematic representation of the present invention utilizing an alternative steering means for use at the helm.
Figure 12:
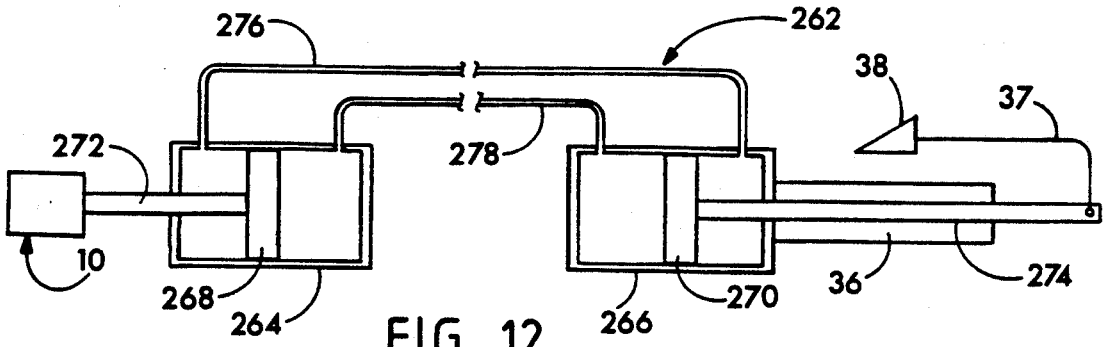
FIG. 12 is a schematic representation of still another alternative steering means for use at the propulsion unit.

Another alternative embodiment is illustrated in FIGS. 11 and 12, which differ primarily from the embodiments shown in FIGS. 1–10 in that the actuable steering means uses a hydraulic arrangement rather than a mechanical push-pull cable. It will be observed that such a hydraulic steering means can be used at either the input end to the power steering assist means or at the output end, or both. As shown in FIG. 11, a hydraulic steering means between the helm and power steering assist means comprises an operator activating means 242 at the helm, and in lieu of a gear housing, and includes a suitable source 244 of pressurized hydraulic fluid, e.g. oil, and a suitable pump with a valve control 246 for selectively directing or pumping hydraulic fluid to hydraulic cylinder 248 in response to steering movement at the helm. The hydraulic cylinder assembly 248 comprises a cylinder 250 which is affixed at one end to sleeve 54. Reciprocating piston 252 is slidably mounted in cylinder 250, and divides the cylinder into chamber 254 and 256. Piston rod 258 extends from the piston at the head end, outwardly from the cylinder and is slidably insertable in sleeve 54. The opposed end of the piston rod is operably connected to connecting member 60 such that reciprocal movement of piston rod 258 actuates connecting member 60. Conduits 260 and 261 are connected at one end to activating means 242 and at their opposite ends to opposed chambers 254 and 256, respectively, in cylinder 250. Hydraulic fluid is pumped from the activating means through one of the conduits and to one cylinder chamber and drained from the other cylinder chamber through the other conduit and returned to the activating means. Thus, upon steering movement at the helm, pressurized hydraulic fluid entering a cylinder chamber moves the piston in one direction or the other, which in turn reciprocates the piston rod and thereby actuates the power steering assist means 10.

If hydraulic fluid actuable steering means is utilized at the output end, as shown in the alternative embodiment in FIG. 12, a dual cylinder-piston assembly 262 of essentially identical construction is utilized. Cylinder 264 desirably is mounted to support means 208, and cylinder 266 desirably is mounted on or near the propulsion unit, and each cylinder includes a reciprocating piston 268 and 270 thereby defining opposed chambers for each cylinder. Piston rod 272, extending from piston 268 outwardly from cylinder 264, is actuably connected to the power steering assist means as by anchor bracket 200, explained above. Piston rod 274 extends from piston 270, through tilt tube 36, and is operably connected at its opposite end to steering link 37 which actuates steering arm 38. Conduits 276 and 278 transport hydraulic fluid between cylinders 264 and 266 in opposite directions upon steering actuation. Thus, when steering actuation moves the piston rod 272 to the left, as shown in FIG. 12, piston 268 moves to the left and forces hydraulic fluid from one chamber of cylinder 264 to one chamber of cylinder 266, and thereby reciprocates piston rod 274 to the left to effect steering movement to the left. As the piston 270 moves to the left, oil is forced from the other chamber of cylinder 26 to the opposed chamber of cylinder 264. Similarly, steering to the right effects the flow of hydraulic fluid in an opposite direction.

Figure 13:
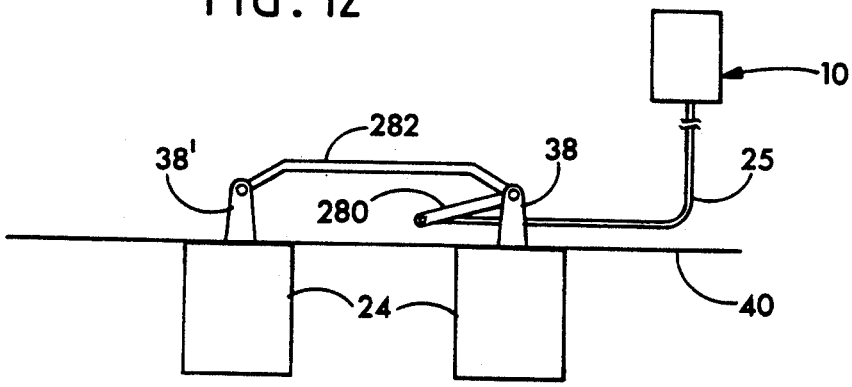
FIG. 13 is a schematic representation of an alternative embodiment utilizing the present invention for two engines.
Figure 14:
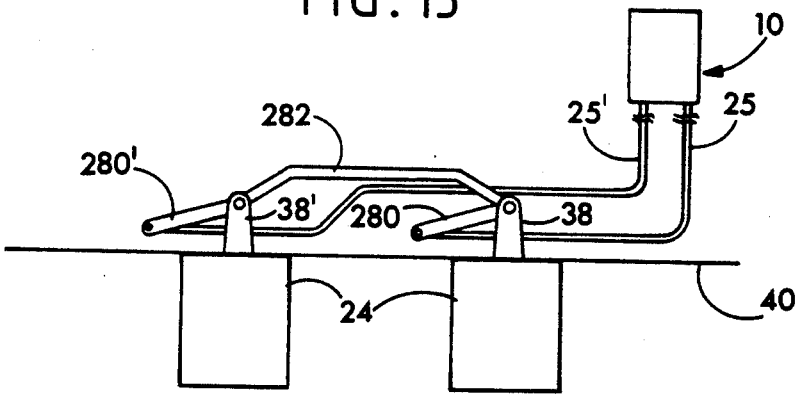
FIGS. 14 and 15 are still further embodiments showing use of the present invention for two engines.
Figure 15:
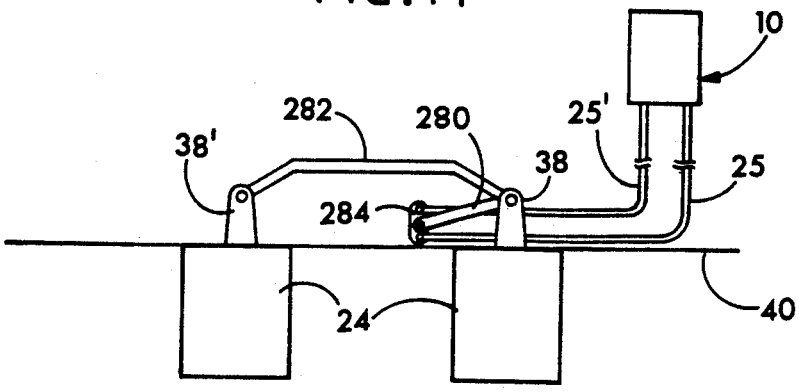

FIGS. 13, 14 and 15 illustrate alternative embodiments of how the present invention may be utilized with a plurality of propulsion units. In the illustrated arrangements, two propulsion units 24 in side-by-side relationship are supported by the transom 40 of the boat. The propulsion units are operably connected to a suitable actuating steering means 25 or 25', e.g. mechanical push-pull cable, to provide actuable output from the power steering assist means so as to pivot the propulsion units about a vertical steering axis as described above. Referring more specifically to FIG. 13, there is illustrated two propulsion units operably connected to a single steering means such as a cable 25 extending from the power steering assist means, which is mounted remotely from the propulsion unit. Steering arm 38 is operably connected to the opposite end of the cable by rigid steering link 280, which is connected at one end to the cable and pivotally connected at its opposite end to the steering arm 38. A rigid tie bar 282 extending horizontally between the steering arms 38 and 38' for each propulsion unit is pivotally mounted at each end to the steering arm. Upon steering movement at the helm, actuation output at the power steering assist means actuates the steering means 25 thereby pivoting the steering link 280. As a consequence, the steering arms 38 and 38' move in unison in response to the steering actuation, and both propulsion units are pivoted in the same direction.

The arrangement illustrated in FIG. 14 differs from that shown in FIG. 13 only in that two actuable steering means or cables are used for steering the engines. Thus, steering cables 25 and 25' provide output actuation in unison, and because of the steering links 280 and 280' and tie bar 282, the steering arms 38 and 38' move in unison and the propulsion units move in a common direction.

FIG. 15 illustrates a somewhat different arrangement showing how the power steering assist means of the present invention can be used with two or more engines. Here the two steering cables are operably connected to a connector 284, and steering link 280 is pivotally connected to the connector. Thus, upon steering actuation at the helm, the two cables 25 and 25', actuated simultaneously, actuate the steering link 280 to move the steering arm 38 of the first engine and pivots the tie bar 282 to move the steering arm 38' of the second engine. Hence, the steering arms move in unison, and both propulsion units steer in the same direction.

It will be observed that the present invention provides a means for an in-line power steering system. As a consequence, the power steering system is not mounted on either the propulsion unit or at the steering helm, but rather is interposed between these two members. Hence, the system can fit any engine, regardless of the design and without any design modification to the engine or the required use of special bracketry, and, if desired, can be retrofit to an existing engine. Also of significance is the fact that the invention eliminates the need for high pressure oil lines, which are required for a conventional power steering system, and subject to physical abuse and exposure. That is, in the present invention, the high pressure passage is contained within the power steering system, and there are no external high pressure oil lines. The power steering system can be mounted most anywhere within the hull or to one side of the deck or against a side board, and further may be easily protected by the boat parts or by a separate cover.

The foregoing detailed description has been given for clearness of understanding only, and no unnecessary limitations should be understood therefrom, as modifications will be obvious to those skilled in the art.

What is claimed is:

1. An in-line power steering system for a marine vehicle comprising a propulsion unit pivotal about a steering axis, steering means for applying torque to said propulsion unit to effect steering movement thereof about said steering axis and including an operator actuable steering helm and a steering member connected to said propulsion unit; power steering assist means having a reciprocating mechanical output force and operably connected to, and operably interposed between, said steering helm and said propulsion unit and mounted remote from said propulsion unit; a first actuable steering means operably connected (a) to said steering helm and actuated in response to steering actuation at said steering helm and (b) to said power steering assist means to effect actuating input to said power steering assist means upon actuation at said steering helm; and a second actuable steering means for accepting said mechanical output force and operably connected to said power steering assist means and to said steering member for overcoming torque on said propulsion unit relative to said steering axis in response to actuation of said second actuable steering means, said second actuable steering means providing actuable output transmitted from said power steering assist means to effect common movement of said steering member in response to steering actuation of said steering helm to pivot said propulsion unit about said steering axis.

2. An in-line power steering system according to claim 1 wherein said second actuable steering means comprises a second push-pull cable having a flexible sheath and inner core axially slidable in said sheath, said inner core having a first end operably connected to said power steering assist means to provide actuating output and a second end operably connected to said steering member, said inner core slidably actuated in response to actuation of said power steering assist means for effecting common movement of said steering member.

3. An in-line power steering system according to claim 2 wherein said first actuable steering means comprises a first push-pull cable having a flexible sheath and inner core axially slidable in said sheath, said inner core having a first end operably connected to said steering helm and a second end operably connected to said power steering assist means, said inner core slidably actuated in response to steering actuation at said steering helm to effect actuating input to said power steering assist means.

4. An in-line power steering system according to claims 1 wherein said first actuable steering means comprises a hydraulic means disposed at the helm and operably connected to the power steering assist means, and including a cylinder, a piston reciprocally mounted in said cylinder, a piston rod extending from said piston and operably connected to said power steering assist means, and means for delivering pressurized hydraulic fluid to said cylinder upon steering actuation.

5. An in-line power steering system according to claims 2 wherein said first actuable steering means comprises a hydraulic means disposed at the helm and operably connected to the power steering assist means, and including a cylinder, a piston reciprocally mounted in said cylinder, a piston rod extending from said piston and operably connected to said power steering assist means, and means for delivering pressurized hydraulic fluid to said cylinder upon steering actuation.

6. An in-line power steering system according to claim 1 wherein said first actuable steering means comprises a hydraulic means disposed at the helm and operably connected to the power steering assist means, and including a cylinder, a piston reciprocally mounted in said cylinder, a piston rod extending from said piston and operably connected to said power steering assist means, and means for delivering pressurized hydraulic fluid to said cylinder upon steering actuation; and said second actuable steering means comprises a hydraulic means disposed between the propulsion unit and the power steering assist means, and including a first cylinder and a first piston reciprocally mounted in said first cylinder having a piston rod extending from said first piston and operably connected to said power steering assist means, and a second cylinder and a second piston reciprocally mounted in said second cylinder having a piston rod extending from said second piston and operably connected to said steering member, and fluid communication means between said first and second cylinders, whereby reciprocable movement of said first piston reciprocably moves said piston for effecting movement of said steering member.

7. An in-line power steering system for a marine vehicle comprising a propulsion unit pivotal about a steering axis, steering means for applying torque to said propulsion unit to effect steering movement thereof about said steering axis and including an operator actuable steering helm and a steering member connected to said propulsion unit, a first actuable steering means operably connected to said steering helm and actuated in response to steering actuation at said steering helm, power steering assist means interposed between said steering helm and said propulsion unit and mounted remote from said propulsion unit and hydraulically actuated in response to steering actuation at the steering helm, actuating means for regulating the flow of hydraulic fluid through said power steering assist means and operably connected to said first actuable steering means, and a second actuable steering means comprising a push-pull cable having a flexible sheath and inner core axially slidable in said sheath, said inner core of said second cable having a first end operably connected to said power steering assist means for overcoming torque on said propulsion unit relative to said steering axis in response to axially slidable movement of said inner core of said second cable, and said inner core of said second cable having a second end operably connected to said steering member for effecting common movement of said steering member in response to axial slidable movement of said inner core of said second cable upon steering actuation of said steering helm to pivot said propulsion unit about said steering axis.

8. An in-line power steering system according to claim 7 wherein said first actuable steering means comprises a first push-pull cable having a flexible sheath and inner core axially slidable in said sheath, said inner core having a first end operably connected to said steering helm and a second end operably connected to said actuating means, said inner core slidably actuated in response to steering actuation at said steering helm to effect actuating input to said power steering assist means.

9. An in-line power steering system as in any one of the preceding claims wherein said power steering assist means includes a hydraulic fluid cylinder-piston assembly, hydraulic fluid source means including means for delivering pressurized hydraulic fluid to said cylinder-piston assembly, fluid communication means for providing communication between said cylinder-piston assembly and said fluid source means, valve control means disposed in said cylinder-piston assembly biased to a closed position for a no steering change position and adapted to establish fluid communication between said cylinder-piston assembly and said fluid source means, actuating means to control the flow of hydraulic fluid delivered from said fluid source means and to selectively actuate said valve control means to establish said fluid communication upon steering actuation, whereby hydraulic fluid is delivered from said hydraulic fluid source means to said hydraulic fluid cylinder-piston assembly.

10. An in-line power steering system in accordance with claim 9 wherein said assembly further includes a cylinder having an open end, a reciprocally mounted piston in said cylinder, an annular ram rod having a central bore extending coaxially in said cylinder from said piston through said open end of said cylinder and mounted for reciprocative movement, rod member having opposed ends extending coaxially of said central bore and operably connected at a first end to said valve control means, said actuating means operably connected to said rod member at its second end and to said ram rod, and a linking member operably connected to said actuating means and to said first actuable steering means and responsive to said steering actuation for effecting common movement of said steering member.

11. An in-line power steering system according to claim 10 wherein said actuating means comprises a body mounted for reciprocative movement on an axis generally coinciding with the axis of said rod member and having adjustable means for adjusting the reciprocative travel distance in both directions of said body, bracket means operably connected to said ram rod outwardly from said open end of said cylinder and having a longitudinal bore adaptable to receive said actuating member, and stop means for arresting the reciprocal travel distance in either direction of said actuating means.

12. An in-line power steering system according to claim 11 wherein said second cable is operably connected to said bracket means, whereby reciprocal movement of said ram rod actuates said second cable.

13. An in-line power steering system according to claim 12 wherein said bracket means extends transversely from said ram rod, and said inner core of said second cable is operably connected to said bracket means.

14. An in-line power steering system according to claim 13 further including a sleeve member laterally extending from said bracket means for reciprocal movement in common with reciprocal movement of said ram rod, and said inner core of said second cable extending into said sleeve member and affixed thereto.

15. An in-line power steering system according to claim 14 further including a support means spaced from said bracket means, said sleeve member includes a first sleeve in spaced parallel relationship to said hydraulic cylinder-piston assembly and extending transversely from said bracket means for reciprocal movement in common with reciprocal movement of said ram rod, a second sleeve adaptable to slidably engage with said first sleeve and affixed to said support means, said inner core of said second cable extending into said first and second sleeves and affixed at its end to said first sleeve, whereby reciprocal movement of said ram rod reciprocates said first sleeve thereby actuating said inner core of said second cable.

16. An in-line power steering system according to claim 15 wherein said cylinder of said hydraulic cylinder-piston assembly further having a closed end, reservoir means in fluid communication with said hydraulic fluid source means, said piston having a head and ram end, said annular ram rod operably connected to said piston at said ram end and concentrically arranged in said cylinder to define an annular channel in fluid communication with said fluid source means, means for closing said annular channel, a cylinder chamber defined by said cylinder closed end and said piston head, said rod member coaxially mounted for reciprocal movement in said central bore, first fluid communications means for establishing fluid communication between said hydraulic fluid source means and said chamber and including said annular channel and said valve control means, and second fluid communication means for establishing fluid communication between said chamber and said reservoir and including said valve control means and said central bore, whereby flow of hydraulic fluid is in one direction only.

17. An in-line power steering system according to claim 16 wherein said valve control means comprises a substantially cylindrical valve housing disposed in said piston and extending from about said head to about said ram end of said piston, said valve housing having a longitudinal bore substantially coaxial with the axis of said ram rod and in fluid communication with said central bore of said ram rod, said actuating means operably connected to said valve housing at the ram end of said piston, said valve housing having first and second valves spaced apart along the longitudinal axis of said valve housing, means to bias said first and second valves to a closed position, said first fluid communication means including said first valve, and said second fluid communication means including said second valve.

18. An in-line power steering system according to claim 17 wherein said actuating means further includes an elongated sleeve member having a longitudinal bore adaptable for receiving said second end of said rod member and mounted for reciprocative movement on an axis generally coinciding with the axis of said rod member, said second end of said rod member affixed to said adjustable means, a head member operably connected to said first actuable steering means and outwardly extending from said adjustable means and connected thereto, and means for affixing said elongated sleeve member to said bracket means, whereby actuation of said first actuable steering means actuates said actuating means to selectively open said valve control means.

19. An in-line power steering system according to claim 18 wherein said fluid source means further comprises an accumulator assembly including a cylinder and piston reciprocally mounted in said cylinder, an end cap for said accumulator cylinder, a chamber in said accumulator cylinder defined by said end cap and said accumulator piston for containing hydraulic fluid, fluid passageway in said cap to provide fluid communication between said chamber and said annular channel, inlet means to said chamber extending from said reservoir, and means to bias said accumulator piston against hydraulic fluid in said chamber.

20. An in-line power steering system according to claim 19 wherein said cylinder further includes an end wall, a second chamber defined by said piston and said end wall, and said bias means comprises pressurized nitrogen contained in said second chamber.

21. An in-line power steering system according to claim 20 wherein said hydraulic cylinder-piston assembly and said hydraulic fluid source means is supported by a housing comprising a base plate for mounting to the marine vehicle, a cavity for supportedly receiving said cylinder at the cap end, pump means disposed in said cavity for pumping hydraulic fluid to said chamber from said reservoir, a bore spaced from said cavity, said bore having a first diameter for supportedly receiving said cylinder and a second diameter smaller than said first diameter for slidably receiving said ram rod.

22. An in-line power steering system for a marine vehicle comprising a propulsion unit pivotal about a steering axis, steering means for applying torque to said propulsion unit to effect steering movement thereof about said steering axis and including an operator actuable steering helm and a steering member connected to said propulsion unit; a first actuable steering means operably connected to said steering helm and actuated in response to steering actuation at said steering helm; power steering assist means interposed between said steering helm and said propulsion unit and mounted remote from said propulsion unit and hydraulically actuated in response to steering actuation at the steering helm; said power steering assist means comprises a hydraulic cylinder-piston assembly having a piston reciprocally mounted in said cylinder, hydraulic fluid source means including means for delivering pressurized hydraulic fluid to said cylinder-piston assembly, fluid communication means for providing communication between said cylinder-piston assembly and said fluid source means, valve control means disposed in said cylinder-piston assembly biased to a closed position for a no steering change position and adapted to establish fluid communication between said cylinder-piston assembly and said fluid source means, actuating means operably connected to said cylinder-piston assembly and to said first actuable steering means to control the flow of hydraulic fluid delivered from said fluid source means and to selectively actuate said valve control means to establish said fluid communication upon steering actuation, whereby hydraulic fluid is delivered from said hydraulic fluid source means to said hydraulic fluid cylinder-piston assembly, and connecting means operably connected to said piston; and a second actuable steering means operably connected to said connecting means and to said steering member for overcoming torque on said propulsion unit relative to said steering axis in response to actuation of said second actuable steering means, said second actuable steering means providing actuatable output to effect common movement of said steering member in response to steering actuation of said steering helm to pivot said propulsion unit about said steering axis.

23.An in-line power steering system in accordance with claim 22 wherein said cylinder-piston assembly further includes an annular ram rod having a central bore extending coaxially in said cylinder from said piston outwardly from said cylinder and operably connected to said connecting means, rod member having opposed ends extending coaxially of said central bore and operably connected at a first end to said valve control means, said actuating means operably connected to said rod member at its second end and to said ram rod, and a linking member operably connected to said actuating means and to said first actuable steering means and responsive to said steering actuation for effecting common movement of said steering member.

24. An in-line power steering system according to claim 23 wherein said actuating means comprises a body mounted for reciprocative movement on an axis generally coinciding with the axis of said rod member and having adjustable means for adjusting the reciprocative travel distance in both directions of said body, bracket means operably connected to said ram rod outwardly from said open end of said cylinder and having a longitudinal bore adaptable to receive said actuating member, and stop means for arresting the reciprocal travel distance in either direction of said actuating means.

25. An in-line power steering system according to claim 24 wherein said valve control means comprises a substantially cylindrical valve housing disposed in said piston and extending from about said head to about said ram end of said piston, said valve housing having a longitudinal bore substantially coaxial with the axis of said ram rod and in fluid communication with said central bore of said ram rod, said actuating means operably connected to said valve housing at the ram end of said piston, said valve housing having first and second valves space apart along the longitudinal axis of said valve housing, means to bias said first and second valves to a closed position, said first fluid communication means including said first valve, and said second fluid communication means including said second valve.

26. An in-line power steering system according to claim 25 wherein said actuating means further includes an elongated sleeve member having a longitudinal bore adaptable for receiving said second end of said rod member and mounted for reciprocative movement on an axis generally coinciding with the axis of said rod member, said second end of said rod member affixed to said adjustable means, a head member operably connected to said first actuable steering means and outwardly extending from said adjustable means and connected thereto, and means for affixing said elongated sleeve member to said bracket means, whereby actuation of said first actuable steering means actuates said actuating means to selectively open said valve control means.

27. An in-line power steering system according to claim 26 wherein said fluid source means further comprises an accumulator assembly including a cylinder and piston reciprocally mounted in said cylinder, an end cap for said cylinder, a chamber in said cylinder defined by said end cap and said piston for containing hydraulic fluid, fluid passageway in said cap to provide fluid communication between said chamber and said annular channel, inlet means to said chamber extending from said reservoir, and means to bias said piston against hydraulic fluid in said chamber.

28. An in-line power steering system according to claim 27 wherein said cylinder further includes an end wall, a second chamber defined by said piston and said end wall, and said bias means comprises pressurized nitrogen contained in said second chamber.

29. An in-line power steering system according to claim 28 wherein said hydraulic cylinder-piston assembly and said hydraulic fluid source means is supported by a housing comprising a base plate for mounting to the marine vehicle, a cavity for supportedly receiving said cylinder at the cap end, pump means disposed in said cavity for pumping hydraulic fluid to said chamber from said reservoir, a bore spaced from said cavity, said bore having a first diameter for supportedly receiving said cylinder and a second diameter smaller than said first diameter for slidably receiving said ram rod.

30. An in-line power steering system as in any one of claims 1–5, 7–8, or 22–29 wherein said second actuable steering means comprises a plurality of push-pull steering cables, each of said cables operably connected at one end to said power steering assist means and at the opposite end to said steering member.

31. An in-line power steering system as in any one of claims 1–5, 7–8 or 22–29 further comprising at least one additional propulsion unit, a steering member connected to each propulsion units, and said second actuable steering means operably connected to each of said steering members.

32. An in-line power steering system according to claim 31 wherein said second actuable steering means comprises a plurality of push-pull steering cables, each of said cables operably connected at one end to said power steering assist means and at the opposite end to said steering member for each of said propulsion units.

33. A power steering system especially useful for a marine vehicle having operator steering actuation and adaptable for mounting in-line remote from the propulsion unit of the vehicle, comprising: a cylinder-piston assembly having a cylinder with an open end, a reciprocally mounted piston in said cylinder, an annular ram rod having a central bore extending coaxially in said cylinder from said piston through said open end of said cylinder and mounted for reciprocative movement, hydraulic fluid source means including means for delivering pressurized hydraulic fluid to said cylinder-piston assembly, fluid communication means for providing communication between said cylinder-piston assembly and said fluid source means, valve control means disposed in said piston biased to a closed position for a no steering change position and adapted to establish fluid communication between said cylinder-piston assembly and said fluid source means, rod member having opposed ends extending coaxially of said central bore and operably connected at a first end to said valve control means, actuating means to control the flow of hydraulic fluid delivered from said fluid source means, said actuating means operably connected to said rod member at its second end and to said ram rod to selectively actuate said valve control means to establish said fluid communication upon steering actuation.

34. A power steering system according to claim 33 wherein said cylinder of said hydraulic cylinder-piston assembly further having a closed end, reservoir means in fluid communication with said hydraulic fluid source means, said piston having a head and ram end, said annular ram rod operably connected to said piston at said ram end and concentrically arranged in said cylinder to define an annular channel in fluid communication with said fluid source means, means for closing said annular channel, a cylinder chamber defined by said cylinder closed end and said piston head, said rod member coaxially mounted for reciprocal movement in said central bore, first fluid communications means for establishing fluid communication between said hydraulic fluid source means and said chamber and including said annular channel and said valve control means, and second fluid communication means for establishing fluid communication between said chamber and said reservoir and including said valve control means and said central bore, whereby flow of hydraulic fluid is in one direction only.

35. A power steering system according to claim 33 or claim 34 wherein said valve control means comprises a substantially cylindrical valve housing disposed in said piston and extending from about said head to about said ram end of said piston, said valve housing having a longitudinal bore substantially coaxial with the axis of said ram rod and in fluid communication with said central bore of said ram rod, said actuating means operably connected to said valve housing at the ram end of said piston, said valve housing having first and second valves spaced apart along the longitudinal axis of said valve housing, means to bias said first and second valves to a closed position, said first fluid communication means including said first valve, and said second fluid communication means including said second valve.

36. A power steering system according to claim 33 or claim 34 wherein said fluid source means further comprises an accumulator assembly including a cylinder and piston reciprocally mounted in said cylinder, an end cap for said accumulator cylinder, a chamber in said accumulator cylinder defined by said end cap and said accumulator piston for containing hydraulic fluid, fluid passageway in said cap to provide fluid communication between said chamber and said annular channel, inlet means to said chamber extending from said reservoir, and means to bias said accumulator piston against hydraulic fluid in said chamber.

37. A power steering system according to claim 36 wherein said accumulator cylinder further includes an end wall, a second chamber defined by said accumulator piston and said end wall, and said bias means comprises pressurized nitrogen contained in said second chamber.

* * * * *